United States Patent [19]

Sekine et al.

[11] 3,980,548

[45] Sept. 14, 1976

[54] AUTOMATIC APPARATUS FOR STRIPPING DEPOSITED METAL FROM A CATHODE PLATE IN ELECTROWINNING PROCESS

[75] Inventors: Kunio Sekine; Yukio Kamata, both of Akita; Yoshio Yamaishi, Kosaka, all of Japan

[73] Assignee: The Dowa Mining Co., Ltd., Tokyo, Japan

[22] Filed: June 10, 1974

[21] Appl. No.: 477,978

Related U.S. Application Data

[62] Division of Ser. No. 301,219, Oct. 26, 1972, Pat. No. 3,847,779.

[52] U.S. Cl. ..... 204/281; 204/297 R

[51] Int. Cl.[2] ..... C25C 7/08

[58] Field of Search ..... 204/281, 297 R, 297 W

[56] References Cited

UNITED STATES PATENTS

| | | | |
|---|---|---|---|
| 2,275,382 | 3/1942 | Smith | 204/297 R |
| 3,036,967 | 5/1962 | Lapham | 204/225 |
| 3,625,806 | 12/1971 | Wennberg | 204/12 X |
| 3,689,396 | 9/1972 | Casagrande et al. | 204/281 X |
| 3,798,151 | 3/1974 | Takamasra et al. | 204/281 |
| 3,840,032 | 10/1974 | Sitges | 204/281 X |

FOREIGN PATENTS OR APPLICATIONS

| | | | |
|---|---|---|---|
| 512,913 | 11/1930 | Germany | 204/12 |

*Primary Examiner*—F.C. Edmundson
*Attorney, Agent, or Firm*—Toren, McGeady and Stanger

[57] ABSTRACT

The present invention is particularly directed to the structure and arrangement of the cathode holder which includes a tapered surface for producing an upturned edge portion on the metal which is deposited on the cathode plate to facilitate stripping of the metal from the plate. An enlarged portion of the holder permits engagement thereof to enable smooth pivotal motion of the holder relative to the plate so that the holder may be readily oriented with respect to the plate and, therefore, used repeatedly.

3 Claims, 12 Drawing Figures

AUTOMATIC APPARATUS FOR STRIPPING DEPOSITED METAL FROM A CATHODE PLATE IN ELECTROWINNING PROCESS

This is a division of application Ser. No. 301,219, filed Oct. 26, 1972, now U.S. Pat. No. 3,847,779.

This invention relates to an automatic apparatus for stripping deposited metal, such as zinc, copper or the like, from cathode plates in an electrowinning process.

Since the dimensions of electrodes have become increasingly larger and automated electrolytic processes are required, attempts have been made to automate the process of stripping deposited zinc from the surface of cathodes in lieu of the conventional and inefficient hand operation.

One object of the present invention is to provide an improved automatic stripping machine which operates more efficiently than known, existing machines.

Another object of this invention is to provide a metal stripping apparatus of the scraper type by which metal stripping can be carried out without any striking force or the like which would cause deformation of the cathode plate and making noise.

A further object of this invention is to provide a metal stripping apparatus with which a reliable operation can be carried out regardless of the conditions of the deposit.

Other objects of the invention will be apparent hereinafter from the specification and from the recital of the appended claims, particularly when read in conjunction with the accompanying drawings.

Figure 3:
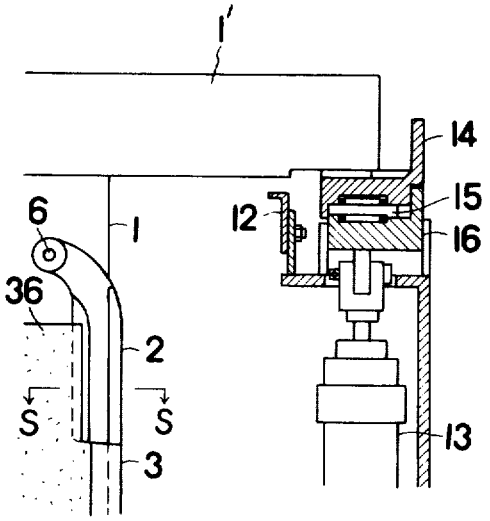
FIG. 3 is a sectional view taken along the line 0—0 in FIG. 1 showing the feeder for carrying cathode plates.
Figure 5:
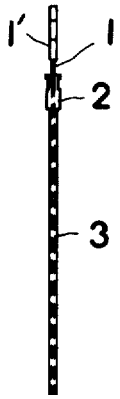
FIG. 5 is a side view of the cathode plate in FIG. 4.
Figure 4:
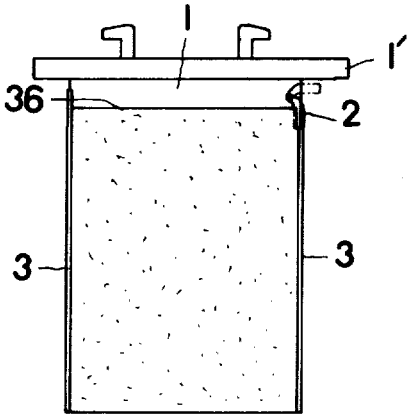
FIG. 4 shows an elevation of a cathode plate.
Figure 6:
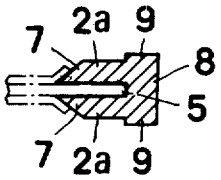
FIG. 6 shows a section taken along the line S—S in FIG. 3.

Referring now to the drawings and firstly to FIG. 3, a cathode plate 1 used according to this invention has a movable holder 2 and a set of conventional stationary edge strips 3. After an electrolytic operation is carried out in an electrolytic bath, the cathode plates 1 are drawn up and washed and then put on a conveyor 4. The movable holder 2 is made of electrically non-conductive and acid-proof material and has a groove 5 having one side opened in a square shaped configuration. The upper part of one side edge of the cathode plate 1 is clipped or received in the groove 5 and the holder is attached to the cathode plate by means of pivot pin 6 (see FIG. 3). As shown in FIG. 6, the clipping portion 2a of the movable holder 2 has tapered faces 7 on the outer sides at which the groove 5 is opened. At the other side 8 the holder 2 has an enlarged portion 9 adapted to be engaged by a lifting arm of a movable holder lifter so that the movable holder can be turned and lifted.

Figure 1:
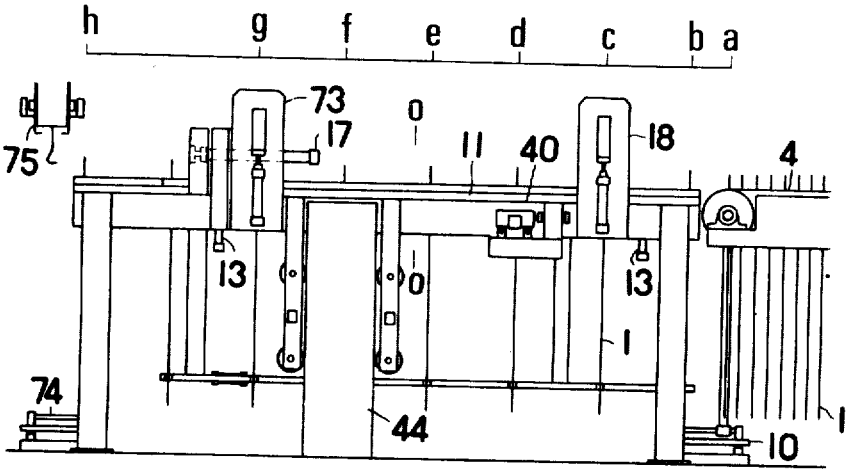
FIG. 1 is a side elevational view showing an automatic metal stripping apparatus constructed according to one embodiment of this invention.
Figure 2:
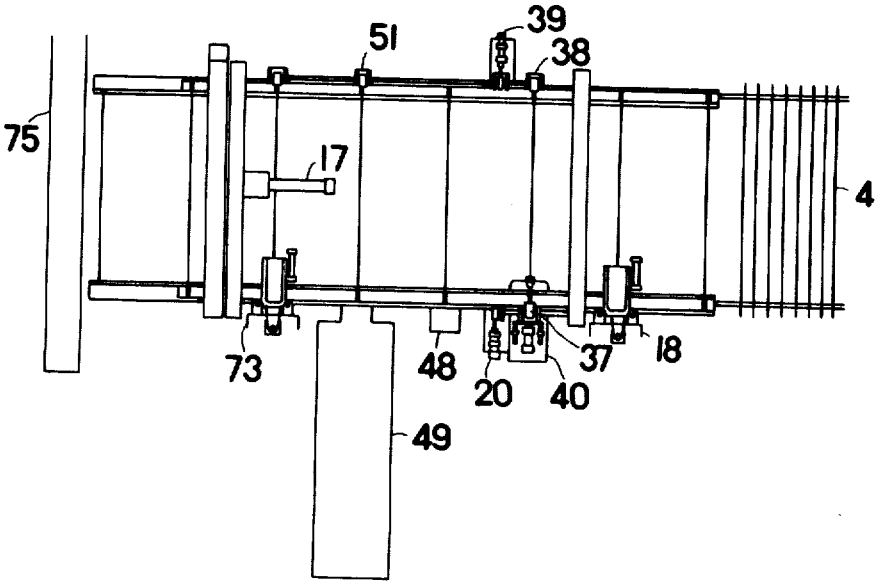
FIG. 2 is a plan view of the apparatus shown in FIG. 1.

Referring now to FIGS. 1 and 2, the conveyor 4 carries the cathode plate 1 by an intermittent movement to a station (a) from which a delivering device 10 moves the plate to a station (b) at which the cathode plate is put down on hanger plates 12 provided in a feeder 11 as shown in FIG. 3. Next, being supported on sliding rails 14, the cathode plate 1 is lifted by a cylinder 13. Then resting on the sliding rails mounted on sliding bearings 15 and their support plates 16, the cathode is moved by a transfer cylinder 17 to a station (c) at which it is again put down on the hanger plates 12 by the cylinder 13.

Figure 7:
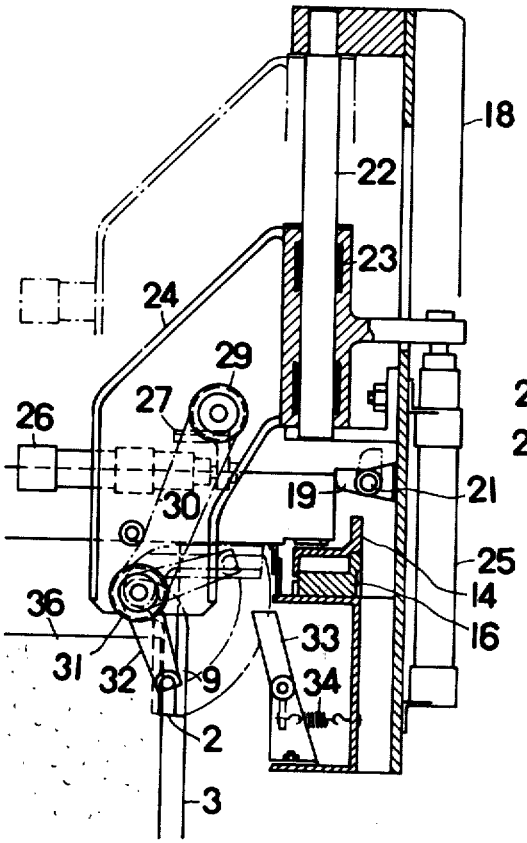
FIG. 7 is a side section view showing a lifting device for a movable cathode holder.
Figure 8:
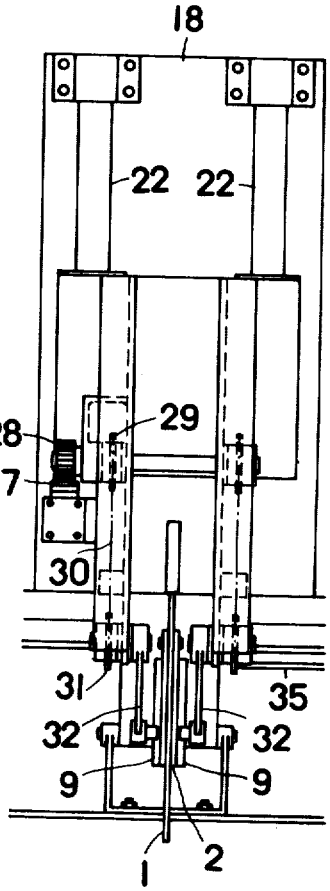
FIG. 8 is a vertical and front view of the device shown in FIG. 7.

At the station (c) a lifting device 18 for the movable holder 2 is actuated to lift or turn the holder. As shown in FIGS. 7 and 8, in order that during the movement of the cathode plate, which is subjected to a force in the lateral direction, is accurately positioned, locking arms 19 are turned from a position as shown by a dot and dash line in FIG. 7 by actuation of a locking cylinder 20 (FIG. 2) through a shaft 21 (FIG. 7) to clamp a beam 1' of the cathode plate 1.

Firstly a bracket 24 is supported on a guide shaft 22 by means of bearings 23 in a position as shown by a dot and dash line in FIG. 7. When the transfer movement of the cathode is finished, the bracket 24 moves down by the action of a cylinder 25 in a vertical direction and stops at a position at which the movable holder 2 can be lifted.

Next a cylinder 26 for lifting the holder is actuated to turn the lifting arms 32 upward by means of a transmission comprising a rack 27, a gear 28, a sprocket 29, a roller chain 30 and a sprocket 31. At that time the tips of the lifting arm 32 are engaged with the enlarged portion 9 of the movable holder 2 and pushes or turns the latter upwardly. During the turning movement the movable holder 2 pushes away a holder support 33 and is lifted up to a position as shown by a dot and dash line in FIG. 7.

When the lifting movement ends, holder lifting cylinder 26 returns to move the holder lifting arm 32 to the initial position and successively the cylinder 25 moves vertically to return and to lift the bracket 24 to the initial position where it does not hinder the travel of the cathode plate 1.

Figure 9:
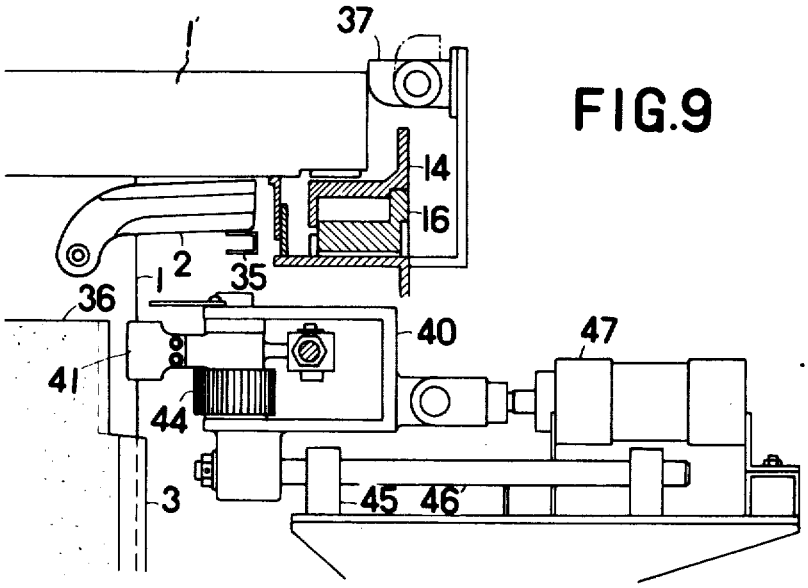
FIG. 9 is a side view of a preliminary stripping device.

The movable holder 2 in its lifted position is supported by the holder support 33 retained by a spring 34 and is prevented from dropping. During the movement of the cathode plate 1 the holder 2 is carried on the guide rail 35 (FIGS. 8 and 9) to slide without dropping until it reaches the station *d* at which a preliminary stripping operation is carried out.

Electrodeposited metal 36 at its portion in which the movable holder 2 is lifted from the plate 1 is shown as deposited in a form that the end seam is separated outward from the plate.

When the cathode plate 1 arrives at the predetermined position, a beam 1' on the plate 1 is locked by lateral locking members 37, 38 which are moved at the locking position by the action of locking cylinders 20, 39 respectively.

Figure 10:
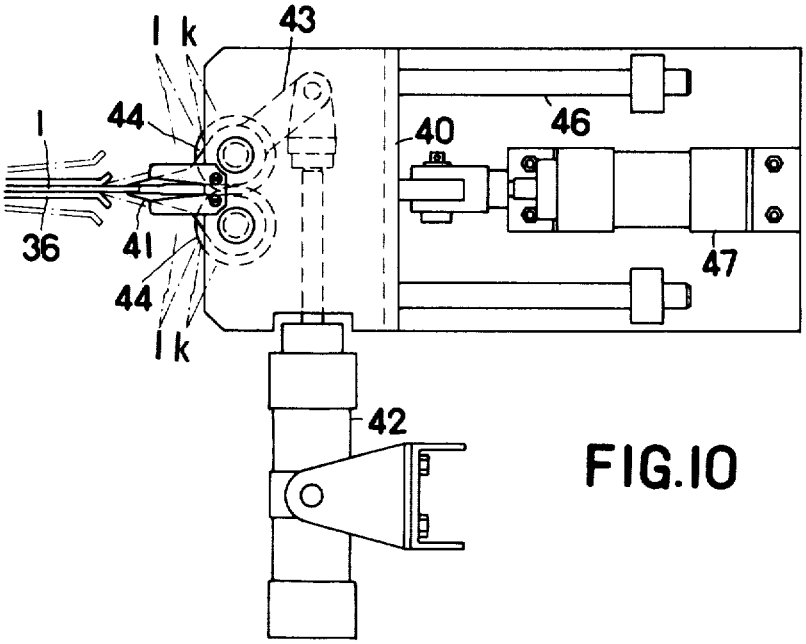
FIG. 10 is a plan view of the device in FIG. 9.

As shown in FIG. 10, the head portion of a preliminary stripping device 40 is positioned in the condition that a pair of scraper blades 41 is opened as shown by a dot and dash line *k* in FIG. 10.

When locking action of the cathode plate 1 is finished, the scraper blades 41 are turned and brought in contact with both faces of the plate 1 by the turning of an arm 43 which turning is actuated by a cylinder 42. Gear wheels 44 are provided which are synchronized with the turning of the blades 41. The head of the preliminary stripping device 40 supported by bearings 45 and guide rod 46, is advanced by a cylinder 47. The tips of the anti-abrasive scraper blades 41 are then inserted into a gap formed between deposited metal 36 and the cathode plate 1. When the blades enter into the gap a predetermined distance, the scraper blades are turned or pivoted apart from each other until they reach position 1. After the above mentioned cycle is completed each member or device returns to its initial position.

Upon opening of the scraper blades 41, the electrodeposited metal is separated from the cathode plate to a great extent, but when the tips of the blades 41 leave or are withdrawn from the deposited metal, the deposited metal tends to return to the initial state or position by its own resiliency. However a certain gap is still maintained between the deposited metal and the cathode plate. Owing to this, after the preliminary stripping, the deposited metal is in a state in which it can be easily stripped off from the cathode plate 1 by a main scraper which operates at a following station.

It has been proved from actual operations that according to this invention the distance of separation between the stripped metal and the cathode plate is 15–20 mm and that of the stripped part is longitudinally 200–300 mm at the scraper side and about one half of this at the counter side.

It has also been verified that if this preliminary treatment leads to a favorable partial stripping, the main stripping operation can be successfully carried out under the extremely improved conditions without abrasion and damage of the cathode plate by the tips of the main scraper.

The main scraper body does not directly contact the cathode plate so that the plate can be prevented from being mechanically damaged and the stripping operation can be smoothly carried out at high speed.

When the above-mentioned pretreatment ends, feeder 11 is actuated to bring the cathode plate 1 to the process for detecting the result of the preliminary stripping at the station *e*.

In the detecting process an electrically or mechanically actuated detector 48 is operated to detect whether the preliminary stripping is completely carried out and to send a signal to the main stripping device 49.

As detection is finished, the cathode plate 1 is delivered by the feeder 11 to the main stripping device at the station *f*.

Figure 11:
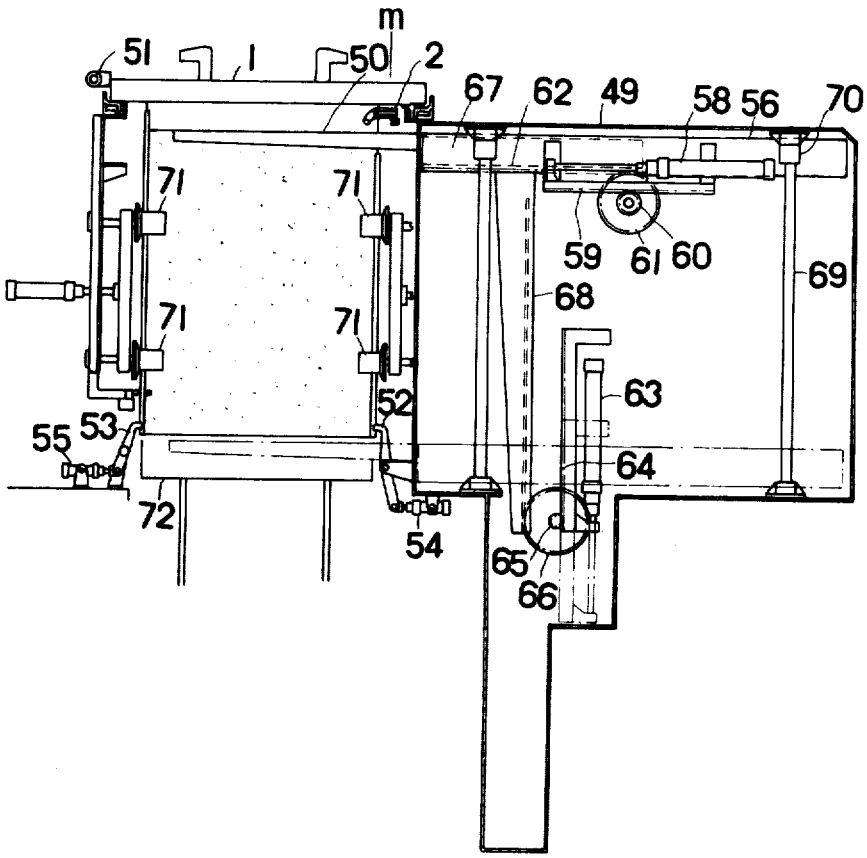
FIG. 11 is a side view of a main stripping device.
Figure 12:
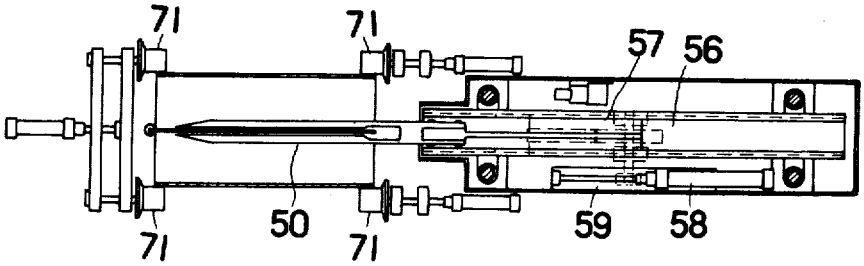
FIG. 12 is a plan view of the device in FIG. 11.

As clearly shown in FIGS. 11 and 12, the main stripping device 49 has a scraper 50 having tips which are retracted to the position *m* during the travelling of the cathode plate 1. When the cathode plate 1 reaches the main stripping position, locking member 51 is actuated by a cylinder 39 to firmly secure the beam 1' of the cathode plate 1 in position, and locking members 52, 53 are actuated by cylinder 54 and 55 to firmly secure the plate 1 at its lower part. The scraper 50 which is made by precise machining to completely prevent any lateral and vertical deviations is supported by lubricated slide guide 56 and slide head 57 and is actuated by a pushing cylinder 58 through rack 59, pinion 60, gear 61 and rack 62. The scraper is advanced so that its tips are inserted into the gaps which have already been formed between the cathode plate 1 and the deposited metal 36 in the preliminary stripping operation whereby at first the upper portion of the deposited metal is stripped. Next a cylinder 63 disposed to provide for a vertical operational movement is actuated to actuate a rack 68 which is connected with frame 67 through rack 66, pinion 65 and gear 64 associated with the cylinder. The rack 68 moves the scraper 50 downwardly without lateral and vertical deviations which are prevented by the arrangement wherein the scraper is supported on the frame guide 69 by means of slide bearing boxes 70. Consequently the deposited metal is stripped on both faces of the cathode plate 1 at the same time and the stripped metal passes through guide rollers 71 and falls in a container 72 from which it is meanwhile delivered to a stacker stationed under the stripping apparatus.

As mentioned above in detail, the automatic stripping apparatus according to this invention provides a preliminary stripping operation before the cathode plate comes up to the scraper of the main stripping device, whereby the scraper can be inserted into the gap to strip the deposited metal speedily and smoothly. Additionally as the upper and horizontal stripping on one hand and the vertical stripping on the other can be carried out successively by the same scraper, stripping efficiency is extremely increased.

According to the actual operation of the apparatus constructed according to this invention, the time necessary for the treatment of one cathode plate is 8 or 9 seconds.

When the stripping process is finished, the respective devices return to their starting positions and the cathode plate is passed by the feeder 11 to a resetting device 73 at a station *g* at which the movable holder 2 is reset correctly to the cathode plate. Next, the cathode plate 1 is delivered by the feeder 11 to a station *h*, transferred to the conveyor 75 by a delivering device 74, and again returned to the electrolytic bath.

When the detector 48 detects, in the above described deposit metal stripping cycle, that the preliminary stripping operation is not satisfactorily carried out, a signal is provided and the cathode plate is not submitted to the following stripping operation but rather is directly discharged for special treatment. Incomplete operation of the preliminary stripping is usually caused by the fact that a sufficient gap is not formed by the movable holder between the deposited metal 36 and cathode plate 1 or for any reason the electrodeposition is not perfect at the portion at which the gap is formed.

As clearly shown in FIG. 10, the tips of the scraper blades have a locus drawn to advance toward the cathode plate 1 for the first time so that sufficient preliminary stripping is obtained if the tips are engaged with even a little of the deposited metal 36.

According to this invention, as clearly described above, stripping of deposited metal from the cathode plate can very easily and exactly be carried out at necessarily high speed and without damaging the cathode plate.

What I claim is:

1. A cathode holder assembly on apparatus for stripping deposited metal from a cathode plate in an electrolytic metal winning process including a plurality of operating stations, said cathode plate being electrolytically insulated over substantially the entire length of its peripheral edge portion with the exception of a relatively small edge portion left uninsulated, said cathode holder assembly comprising a cathode holder having a pair of walls including a pair of facing inner sides defining therebetween a slot with an opening through which said uninsulated peripheral edge portion of said cathode plate may be received within said slot between said inner sides, said pair of walls also including a pair of outer sides facing away from said slot with each of said outer sides having a tapering configuration converging toward said opening of said slot, said tapering configuration causing formation of an upturned edge portion of the metal deposited on said cathode plate when said metal is deposited with said uninsulated peripheral edge portion of said cathode plate positioned within said slot, means pivotally mounting said cathode holder on said cathode plate, and means for pivoting said cathode holder relative to said cathode plate for inserting and removing said uninsulated peripheral edge portion of said cathode plate into and out of said slot.

2. A cathode holder according to claim 1 wherein said cathode holder is made of electrically nonconductive and acid resistant material.

3. A cathode holder assembly according to claim 1, wherein said means for pivoting said cathode holder include an enlarged portion on said cathode holder adapted to be engaged by an external device to facilitate pivoting of said cathode holder from a position where said slot receives said edge portion of said cathode plate to a position where such slot is free of said edge portion of said cathode plate.

* * * * *